US005307564A

United States Patent [19]

Schoenberg

[11] Patent Number: 5,307,564

[45] Date of Patent: May 3, 1994

[54] SAFETY RAZOR

[76] Inventor: Frederic D. Schoenberg, 628 Ocean Ave., Sea Bright, N.J. 07760

[21] Appl. No.: 983,674

[22] Filed: Dec. 1, 1992

[51] Int. Cl.[5] ..... B26B 21/00; B26B 21/10; B26B 21/14

[52] U.S. Cl. ..... 30/50; 30/48; 30/47

[58] Field of Search ..... 30/47, 48, 50, 85, 299, 30/501, 502

[56] References Cited

U.S. PATENT DOCUMENTS

| | | | |
|---|---|---|---|
| 522,749 | 7/1894 | Bedell | 30/502 |
| 1,643,385 | 9/1927 | Kennedy | 30/50 |
| 2,587,964 | 3/1952 | Burns | 30/50 |
| 3,593,416 | 7/1971 | Edson | 30/50 |
| 4,501,066 | 2/1985 | Sceberras | 30/50 |

*Primary Examiner*—Richard K. Seidel
*Assistant Examiner*—Paul M. Heyrana, Sr.
*Attorney, Agent, or Firm*—Robert M. Skolnik

[57] ABSTRACT

A safety razor having two independent separate shaving heads for shaving with and against the grain by pulling the handle of the razor across a working surface, then turning the handle about its longitudinal axis and using the other head by pushing the handle to shave against the grain. The shaving head used by pulling is mounted at an angle with respect to the handle and the head used by pushing is mounted substantially parallel to the handle.

6 Claims, 1 Drawing Sheet

SAFETY RAZOR

FIELD OF THE INVENTION

This invention relates to a safety razor and to a dual headed razor having oppositely acting razor blades.

DESCRIPTION OF THE PRIOR ART

Tomchek, U.S. Pat. No. 2,697,874 discloses a razor with opposite razor blades secured in a housing by a compressed spring which it compressed on threading the handle onto the housing. The opposite blades enable the user to move the razor very slightly in both directions to cover a small area efficiently and with a minimum of effort.

Sceberras, U.S. Pat. No. 4,501,066 shows another dual headed razor with oppositely acting blades. A handle is provided with two shanks having channels which receive razor hands in the usual manner. The razor is designed to move in opposite directions.

SUMMARY OF THE INVENTION

The present invention is a dual headed razor which has oppositely acting razor heads attached to a single handle. One of the razor heads is downwardly acting and is affixed to the handle in the conventional manner so that the blade extends downwardly from the handle at a predetermined angle. The second upwardly acting razor head is affixed to the handle such that the blade is extended upwardly substantially parallel with the handle. The first blade is designed to be used in the conventional manner. The second blade is designed to be used in an upward direction. The user simply rotates the handle to apply either of the blades to the skin.

The razor of my invention has several advantages over the razors of the prior art. Because the two cutting blades are independent of each other, the non-cutting blade is not always in contact with the skin so that there is less likelihood of the non-cutting blade being dulled and less likelihood of nicking the skin. In addition, the present invention retains all of the features and advantages of the downwardly acting blade of presently existing safety razors in its ability to shave areas above and around the mustache and sideburns. The present invention is also easy to control because the upwardly acting head is an independent unit and can be manipulated in angle, pressure and contact with the skin when being used in the upward direction and when shaving against the grain.

A principal object of this invention is the provision of a dual headed razor having independent razor units which are not both simultaneously in contact with the skin. Another object of the invention is the provision of a dual headed razor having a first head with downwardly pointing blades to enable the razor to act in the conventional manner and a second head with upwardly pointed blades to shave against the grain in an upward direction. Another object of the present invention is the provision of a dual headed razor having a downwardly extending blade which is mounted at an angle respecting the handle and an upwardly extending blade which is mounted so that it is substantially parallel to the handle.

BRIEF DESCRIPTION OF THE DRAWINGS

These as well as further objects and advantages of the invention will become apparent to those skilled in the art from a review of the following detailed specification of my invention reference being made to the accompanying drawings in which.

DETAILED DESCRIPTION OF THE INVENTION

Figure 1:
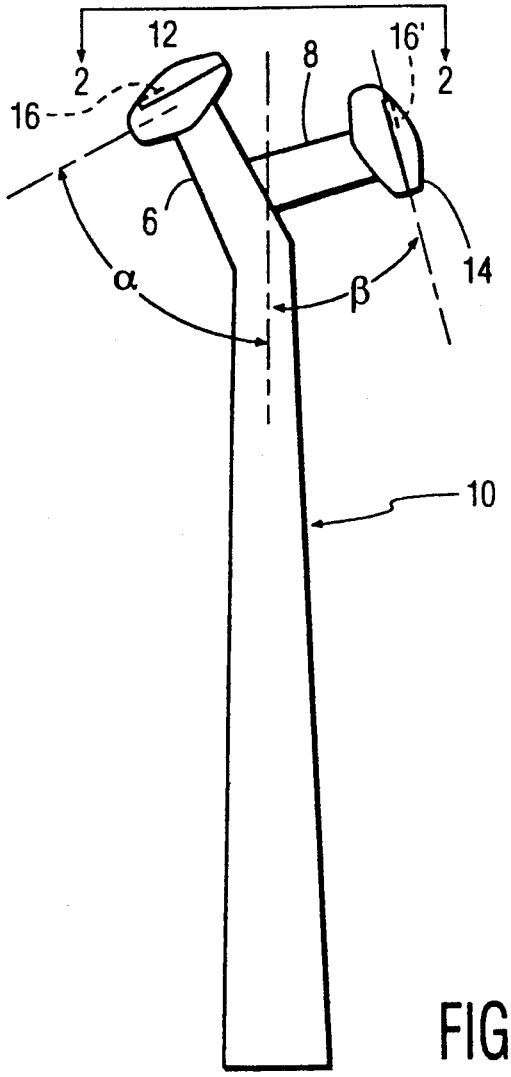
FIG. 1 is a side view of the preferred embodiment of the invention.

FIG. 1 is a side view of the preferred embodiment of my invention. In FIG. 1, the razor has a handle 10. A first shaving head 12 affixed to the handle 10 and has a blade 16 formed therein so that the blade is mounted at an angle "$\alpha$" with respect to the handle. A second shaving head 14 is mounted to the handle 10 so that blade 16' is mounted in head 14 so that it is substantially parallel to the handle 10.

I have found that the angle "$\beta$" between the handle and the blade 16' may be between $\pm 12°$. The shaving heads 12 and 14 are preferably the conventional single or double blade heads available on disposable razors manufactured by BIC, GILLETTE, or WILKINSON. Alternatively, the present invention can employ the replaceable blade heads on the TRAC type non-disposable razors which are widely available.

It is to be noted that the shaving head 14 is connected to handle 10 by a bracket portion 8 which extends outwardly from the bent portion 6 of the handle 10. Other arrangements for attaching the shaving heads 12 and 14 to a handle 10 are within the scope of this invention.

Figure 2:
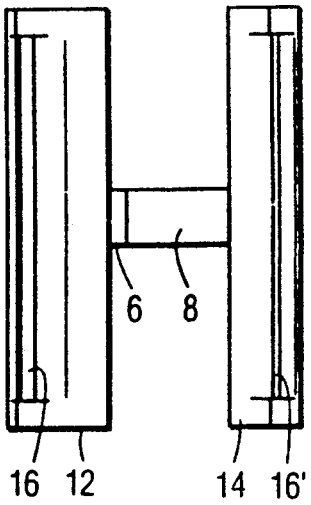
FIG. 2 is a top view of the preferred embodiment of the invention taken along the line 2—2 of FIG. 1.

FIG. 2 is a top view of the invention shown in FIG. 1. As shown in FIG. 2, the two blades 16 and 16' are mounted in shaving heads 12 and 14, respectively. The head 12 is attached to the handle (not shown) by portion 6. Bracket 8 is attached to the portion 6 and supports head 14.

Figure 3:
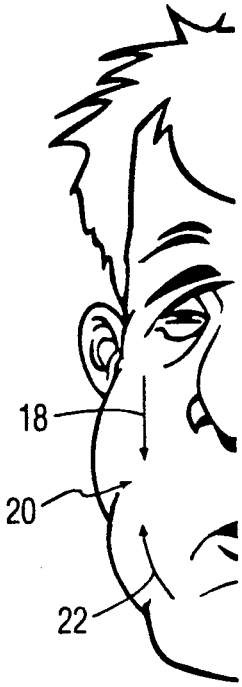
FIG. 3 is a diagrammatic view of the face and how the razor of FIGS. 1 and 2 is to be used.

With reference to FIG. 3, the razor of FIGS. 1 and 2 is employed on the face 20 with head 12 preferably used in the conventional manner in the direction of down arrow 18 and head 14 used in the direction of arrow 22. Either head is applied to the face by rotating the handle 10 about its longitudinal axis.

Further modifications to the invention may be made without departing from the spirit and scope of the invention; accordingly, what is sought to be protected is set forth in the appended claims.

I claim:

1. A razor having oppositely acting shaving heads comprising: a handle having first and second opposite sides, a first blade attached to said handle and extending from said handle over said first side so that the cutting edge of said first blade is directed for use in a first direction at an angle with respect to said handle, a second blade attached to said handle extending from said handle over the second of said sides so that the cutting edge of said second blade is directed in a second direction which is substantially parallel to said handle and which is substantially opposite to said first direction.

2. The razor of claim 1 wherein said first blade is mounted in a shaving head.

3. The razor of claim 1 wherein said second blade is mounted in a shaving head.

4. The razor of claim 1 wherein said first blade is applied to a surface by pulling on said handle and said second blade is applied to a surface by pushing said handle.

5. A safety razor comprising: a handle having first and second ends and first and second opposite sides, a first shaving blade having its cutting edge attached to said handle at said first end at an angle with respect to said handle and in a direction towards said second end and extending towards said first side, and a second shaving blade attached to said handle at said first end opposite to said first shaving blade and extending towards said second side and having its cutting edge in a direction away from said second end.

6. In a shaving razor having a handle with first and second sides and a shaving blade head attached to the first side of said handle at an angle with respect to one side of said handle for shaving in a first direction by pulling on said handle; the improvement comprising a second shaving blade head attached to the second side of said handle so that it is substantially parallel to the other side of said handle for shaving in the opposite direction by pushing on said handle.

* * * * *